United States Patent [19]

Shanker

[11] 4,117,258

[45] Sep. 26, 1978

[54] MODULAR ELECTRIC LIGHT SWITCH ASSEMBLY

[76] Inventor: Benjamin Shanker, 116 Beth Dr., Philadelphia, Pa. 19115

[21] Appl. No.: 688,582

[22] Filed: May 21, 1976

[51] Int. Cl.[2] ..... H01H 9/08

[52] U.S. Cl. ..... 174/53; 339/95 D; 339/122 R

[58] Field of Search ..... 174/53; 339/122 R, 95 D, 339/164 R, 191 R

[56] References Cited

U.S. PATENT DOCUMENTS

| | | | |
|---|---|---|---|
| 2,397,688 | 4/1946 | Osinski | 174/53 |
| 2,908,743 | 10/1959 | Premoshis | 174/53 |
| 2,920,303 | 1/1960 | Johnson | 174/53 X |
| 2,946,977 | 7/1960 | Sheldon | 339/95 |
| 2,952,831 | 9/1960 | Ehrlich | 339/164 R |
| 3,038,141 | 6/1962 | Chiuchiolo | 174/53 X |
| 3,157,732 | 11/1964 | Richards | 174/53 |
| 3,609,647 | 9/1971 | Castellano | 174/53 X |

*Primary Examiner*—J. V. Truhe
*Assistant Examiner*—D. A. Tone
*Attorney, Agent, or Firm*—Brady, O'Boyle & Gates

[57] ABSTRACT

A modular switch assembly provided with a permanently mounted female component including a pair of spaced electrical contact elements connected to a source of electrical power and a cover for receiving the prongs of a male component which electrically connects and bridges the contact elements in the female component to establish a series circuit. Male components are provided which are interchangeable, by removing the prongs of one male component from the female component and reinserting the prongs of another male component.

2 Claims, 7 Drawing Figures

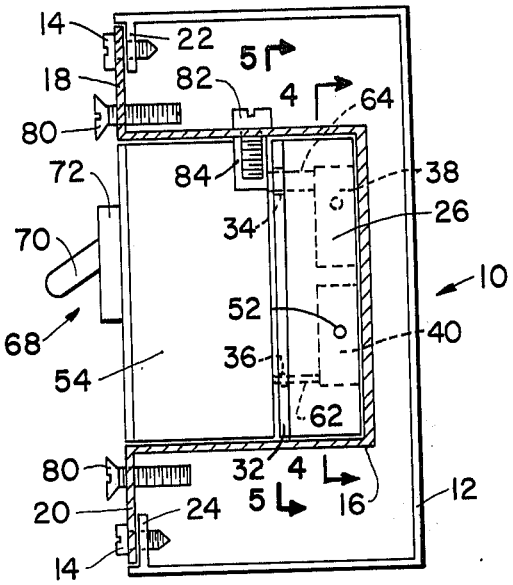
FIG. 1
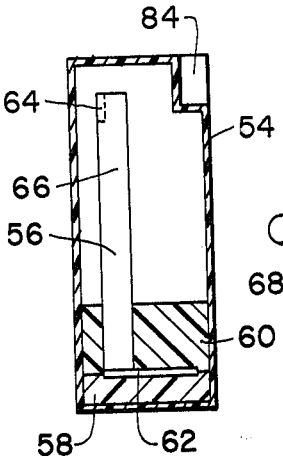
FIG. 3
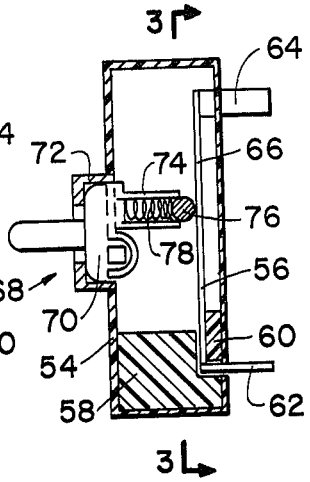
FIG. 2
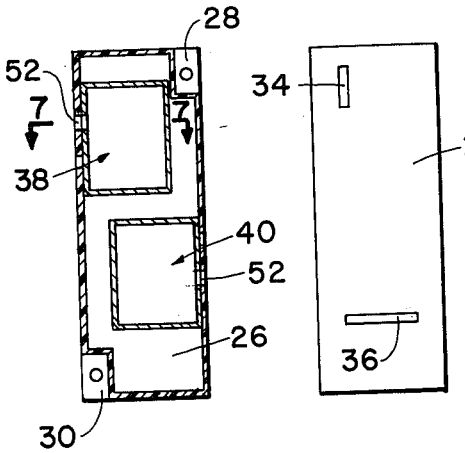
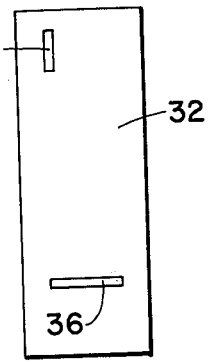
FIG. 4 FIG. 5
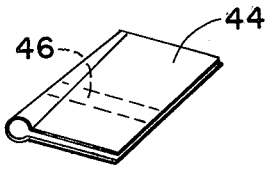
FIG. 6
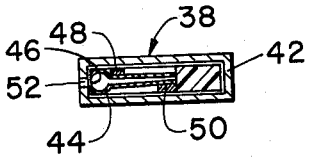
FIG. 7

MODULAR ELECTRIC LIGHT SWITCH ASSEMBLY

BACKGROUND OF THE INVENTION

This invention relates to a plug-in electrical switch assembly, and more particularly, a plug-in switch assembly having interchangeable components.

In order to change an electrical, wall-mounted switch, for example, from a regular toggle switch to a dimmer switch, it is necessary to remove the switch plate cover and remove the electrical wires from the switch assembly. The power to the switch must be turned off in order to avoid the possibility of contact with a current-carrying component of the switch assembly.

SUMMARY OF THE INVENTION

The present invention simplifies this procedure by providing a modular switch assembly in which interchangeable male switch components are merely plugged into a stationary and permanent female component having a pair of contact elements connected to a source of electrical power. The interchangeable male components may comprise rotatable dimmer switches, toggle switches and even plug receptacles.

BRIEF DESCRIPTION OF THE DRAWING

Further objects and advantages of the invention will become more apparent from the following description and claims and from the accompanying drawing, wherein:

FIG. 1 is a longitudinal cross-sectional view through an electrical switch assembly in accordance with the present invention;

FIG. 2 is a longitudinal cross-sectional view through a male plug-in component of the switch assembly of FIG. 1;

FIG. 3 is a cross-sectional view taken substantially along the plane indicated by line 3—3 of FIG. 2;

FIG. 4 is a cross-sectional view through a permanent female component of the switch assembly of FIG. 1 taken substantially along the plane indicated by line 4—4 of FIG. 1;

FIG. 5 is a cross-sectional view taken substantially along the plane indicated by line 5—5 of FIG. 1 at the juncture of the male and female components of the switch assembly;

FIG. 6 is a perspective view of a portion of a contact element permanently mounted in the female component of the switch assembly of FIG. 1; and FIG. 7 is a cross-sectional view taken substantially along the plane indicated by line 7—7 of FIG. 4 and shows a cross-section of the contact elements permanently mounted in the female component of the switch assembly.

DETAILED DESCRIPTION OF THE PREFERRED EMBODIMENT

Referring now to the drawing in detail, wherein like numerals indicate like elements throughout the several views, a wall-mounted switch assembly 10 in accordance with the present invention includes a box 12 in which wire conductors connected to a suitable source of electric power are provided.

Connected to box 12 by suitable threaded fasteners 14 is a switch assembly holder receptacle 16. Receptacle 16 has lateral flanges 18 and 20 which are placed in abutment with flanges 22 and 24, respectively, on box 12. Aligned threaded openings in the abutted flanges 18, 22 and 20, 24 received threaded fasteners 14 in threaded engagement.

Switch assembly holder receptacle 16 houses a permanent and stationary female component 26 which has opposed corner flanges 28 and 30 riveted to the back of receptacle 16. Female component 26 is hollow and includes a cover 32 having a pair of perpendicular electrical prong-receiving openings 34 and 36.

Mounted in the interior of female component 26 on opposed walls are a pair of contact elements 38 and 40. Each of the contact elements 38 and 40 include a metallic housing 42 containing a folded over metallic conductor 44 having a wire-receiving opening 46 through its integral edge. Conductor 44 is made from spring metal and a strip contact 48 and 50 is disposed between housing 42 and the opposite sides of conductor 44. Because of the resiliency of the metal of conductor 44 strip contacts 48 and 50 are held in contact with the surface of conductor 44 and the metallic housing 42.

Current-carrying wires in box 12 are placed through openings 52 in the side of female component 26 into wire-receiving openings 46 in conductors 44 of contact elements 38 and 40 to supply power to the metallic housings 42 of each contact element. Corresponding openings to receive the wires are also provided in the side of receptacle 16. The insertion of the current-carrying wires in each conductor 44 also tends to spread the metal to hold strip conductors 48 and 50 in contact with metallic housing 42.

An interchangeable male switch component 54 is adapted to be inserted in receptacle 16 to bridge contact elements 38 and 40 to connect them in electrical series. Switch component 54 illustrated in FIGS. 1 to 3 comprises a toggle switch, but it should be understood that a dimmer switch, plug receptacle, etc. can be interchanged with the toggle switch by merely unplugging it from female component 26 and re-inserting the substitute component.

Switch component 54 includes a substantially L-shaped conductor 56 sandwiched in cantilever fashion between a pair of insulators 58 and 60. The horizontal leg 62 of conductor 56 comprises a prong inserted through opening 36 in cover 32 of female component 26 into electrical contact with contact element 40. A second conductive prong 64 is also inserted through opening 34 in cover 32 into electrical contact with contact element 38. Normally, however, the vertical leg 66 of L-shaped conductor 56 is spaced from the end of prong 64 and does not contact it unless a toggle mechanism 68 including a rotatable element 70 is pivoted in a housing 72 to the position shown in FIG. 2. Connected to the rear of rotatable element 70 is a housing 74 containing a ball 76 attached to the end of a coil spring 78 compressible within housing 74. Upon pivoting of rotatable element 70 to the position illustrated in FIG. 2, ball 76 wil push vertical leg 66 of cantilever conductor 56 against prong 64 against the force of the compressed spring 78 to establish a series circuit from contact element 40, through horizontal prong 62, vertical leg 66, prong 64 to contact element 38. When rotatable element 70 is canted, as in FIG. 1, there will be insufficient pressure exerted on vertical leg 66 of conductor 56 by ball 76 to retain the contact between leg 66 and prong 64, as the cantilevered leg 66 can spring back away from contact 64 against the spring 78, which will not be compressed a sufficient amount to force leg 66 into contact with prong 64.

As stated heretofore, in order to substitute another male component for component 54, it is only necessary to remove screws 80, which are used to attach a switch plate cover over receptacle 16, and pull the male component 54 from female component 26, removing prongs 62 and 64, and breaking any chance of contact between contact elements 38 and 40. Another male module having similar prongs 62 and 64 is then reinserted into female connector 26 through openings 34 and 36 in cover 32. No exposed wires must be handled or loosened.

Receptacle 16 is grounded by a screw 82 threadedly received through receptacle 16 into a pocket 84 in male module 54.

I claim:

1. A modular switch assembly comprising: a switch component receptacle holder adapted to be mounted in a wall receptacle;

a female component permanently attached in said receptacle holder including, a pair of spaced apart electrical contact elements, each of said contact elements having a metallic housing, first conductor means in said housing adapted to receive in contact therewith current-carrying electrical wires and comprising a resilient metal plate bent back on itself to form a pair of spaced surfaces, said plate having an entry passage into the space between the spaced surfaces for frictionally receiving the current-carrying electrical wires, and second conductor means in said housing for electrically connecting said resilient metallic plate to said metallic housing when resiliently spaced or spread apart by the current-carrying electrical wires, and a cover on said female component having a pair of spaced prong-receiving openings, each of which is in alignment with one of said electrical contact elements; and a male component insertable into said receptacle holder including a pair of protruding electrically conductive prongs extending through said prong-receiving openings in said cover into electrical series contact with said electrical contact elements in said female component.

2. A switch assembly in accordance with claim 1, wherein said male component includes means for opening the electrical series circuit between said prongs.

* * * * *